US006616309B2

(12) United States Patent
Kelmelis et al.

(10) Patent No.: US 6,616,309 B2
(45) Date of Patent: Sep. 9, 2003

(54) ADJUSTABLE MOUNT RECESSED LIGHTING FIXTURE

(76) Inventors: Victor Kelmelis, 3833 Bledsoe Ave., Los Angeles, CA (US) 90066; Maurice Cohen, 6517 Hayes Dr., Los Angeles, CA (US) 90048

( * ) Notice: Subject to any disclaimer, the term of this patent is extended or adjusted under 35 U.S.C. 154(b) by 0 days.

(21) Appl. No.: 09/839,031

(22) Filed: Apr. 20, 2001

(65) Prior Publication Data

US 2002/0154502 A1 Oct. 24, 2002

(51) Int. Cl.[7] ..... F21Y 21/14

(52) U.S. Cl. ..... 362/371; 362/250; 362/365; 362/430

(58) Field of Search ..... 362/250, 365, 362/371, 430, 147, 370; 220/3.5, 477; 174/57, 63

(56) References Cited

U.S. PATENT DOCUMENTS 1,774,935 A * 9/1930 Mangin ..... 362/430
1,849,966 A * 3/1932 Ureles ..... 362/439
2,286,898 A * 6/1942 Cover ..... 220/3.6
2,336,559 A * 12/1943 McChesney, Jr. ..... 220/3.5
2,644,600 A * 7/1953 Senif ..... 248/298.1
2,684,220 A * 7/1954 Beber et al. ..... 220/3.5
3,518,420 A * 6/1970 Kripp ..... 362/365
3,827,685 A * 8/1974 Wennes ..... 269/229
4,712,168 A * 12/1987 Scherrer ..... 362/150
5,082,235 A * 1/1992 Crowther et al. ..... 248/231.41
5,588,737 A * 12/1996 Kusmer ..... 174/65 R
5,609,413 A * 3/1997 Lecluze ..... 362/269
5,746,507 A * 5/1998 Lee ..... 362/147
6,186,639 B1 * 2/2001 Givet ..... 340/541
6,402,111 B1 * 6/2002 Stewart et al. ..... 248/295.11

* cited by examiner

*Primary Examiner*—Alan Cariaso
*Assistant Examiner*—Ismael Negron
(74) *Attorney, Agent, or Firm*—Curtis L. Harrington

(57) ABSTRACT

An adjustable mount lighting system includes a housing for attachment to an anchoring structure, typically a beam within a wall, which is facilitated by the use of adjustable brackets attached to the housing using bolts and attached to the anchoring structure using screws. The housing is preferably of a rectangular shape, at least the end walls of which define a planar portion to which a light-transmitting face plate may be secured using screws. The side walls of the housing have slots therethrough into which the bolts extend, and the adjustable brackets have apertures therethrough into which the bolts simultaneously extend prior to their interconnection with their corresponding nuts. The bolts are translatable within the slots to allow adjustment of the housing with respect to the adjustable brackets, and thus allow depth adjustment of the housing with respect to the anchoring structure and the exterior surface of the face plate with respect to the adjacent structures, which may include a wall or mirror.

8 Claims, 4 Drawing Sheets

ADJUSTABLE MOUNT RECESSED LIGHTING FIXTURE

FIELD OF THE INVENTION

The present invention relates to the field of lighting systems, and more particularly to recessed lighting systems, and provides a structure for facilitating a completely or partially flush recessed lighting arrangement for an enhanced and finely customizable recessed lighting installation.

BACKGROUND OF THE INVENTION

One of the primary reasons that conventional recessed lighting systems, especially over systems which protrude from the wall or ceiling, are highly desirable is that they blend with almost any decor. These lighting systems are typically low-profile, and thus do not represent a commitment by the user to any specific decorating orientation. However, conventional recessed lighting systems are typically designed for installation within a ceiling and usually provide strong incandescent or halogen light in narrowly directed beams or spot lights. This kind of lighting can cause eye fatigue over long periods of exposure. Additionally, the harsh and direct lighting provided by the aforementioned recessed lighting methods are not optimal for use in dressing areas, as they tend to produce a shadow effect and can subsequently be less than helpful in fully and evenly illuminating a subject. Therefore, when lighting a bathroom, vanity area, or other location in which it is preferable that the lighting should be of a softer, more evenly distributed quality.

Another lighting option that may provide a less objectionable form of lighting than that previously described is standard incandescent or fluorescent lighting in the form of a wall sconce or a typical wall-mount or ceiling-mount lighting fixture. Although wall sconces are available in a variety of designs, they may not provide adequate task or subject lighting, since their purpose is usually to provide relatively low-power perimeter lighting in a room. Additionally, wall sources are often open toward the ceiling of a room, causing a large portion of the emitted light to be directed upwardly rather than provide direct illumination. Finally, wall sconces typically command the focus in any room in which they are utilized and are therefore diminished as a low-profile option.

What is therefore needed is a system which facilitates a custom installation, provides adequate and unobtrusive lighting, does not require updating, yet continues to meet the necessary requirements for lighting system operation and serviceability. The needed system should be as structurally secure as a conventional system and should facilitate a customized installation flush with the surrounding wall or mirror. The needed system will also be customizable to project slightly forward of or slightly recessed from the surrounding wall or mirror should a more dramatic lighting effect be desired.

SUMMARY OF THE INVENTION

An adjustable mount lighting system includes a housing for attachment to an anchoring structure, typically a wall or a beam within a wall. Attachment of the housing to the anchoring structure is facilitated by the use of adjustable brackets fastened to the housing using bolts or other similar connectors, and attached to the anchoring structure using screws or other similar hardware. The housing may preferably be a rectangular shape, having two side walls oppositely disposed from one another and both perpendicularly adjacent and contiguous with a rear enclosure, and two end walls contiguous with and perpendicularly adjacent both the rear enclosure and the two side walls, and oppositely disposed one from another. Each wall of the housing has a first planar portion extending from the rear enclosure to an edge, and a second planar portion extending from the edge toward the opposite wall and perpendicular with the first planar portion. The walls of the housing define an opening adjacent which each of the second planar portions of the walls terminate. Furthermore, the second planar portions of the end walls have apertures therethrough at which a light-transmitting face plate, also included in the adjustable mount lighting system, may be fitted and secured using screws or similar hardware. The side walls of the housing optimally have a series of slots therethrough which are perpendicular to the plane occupied by the opening and to the plane of the rear enclosure. The adjustable brackets each have a first planar portion extending to an edge, and a second planar portion extending away from the edge, each of first and second planar portions having a pair of apertures therethrough, the apertures on the second planar portions elongate as compared to those on the first planar portions. The screws used to attach the adjustable brackets to the anchoring structure are insertable into the elongate apertures of the second planar portions of the adjustable brackets at a variety of positions along the length of the aperture in order to facilitate lateral adjustment of the housing with respect to the anchoring structure prior to attachment of the housing to the anchoring structure. The bolts that attach the adjustable brackets to the housing optimally extend through the apertures of first planar portions of the adjustable brackets and through the corresponding slots of the housing to allow the adjustable brackets to be adjusted along the slots by translation of the bolts within the slots so that the adjustable brackets may be secured to the housing at a selectable position anywhere along the length of the slots. This adjustability allows the entire housing to be selectively positioned in a front-to-rear orientation with respect to the anchoring structure so that once the face plate is attached, the adjustable mount lighting system can be made to fit in a variety of positions defined by the position of the exterior surface of the face plate with respect to the surrounding wall or mirror. For example, the adjustable brackets can be positioned so that the face plate of the adjustable mount lighting system fits flush with, projects forward of, or is recessed from the surrounding wall or mirror.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
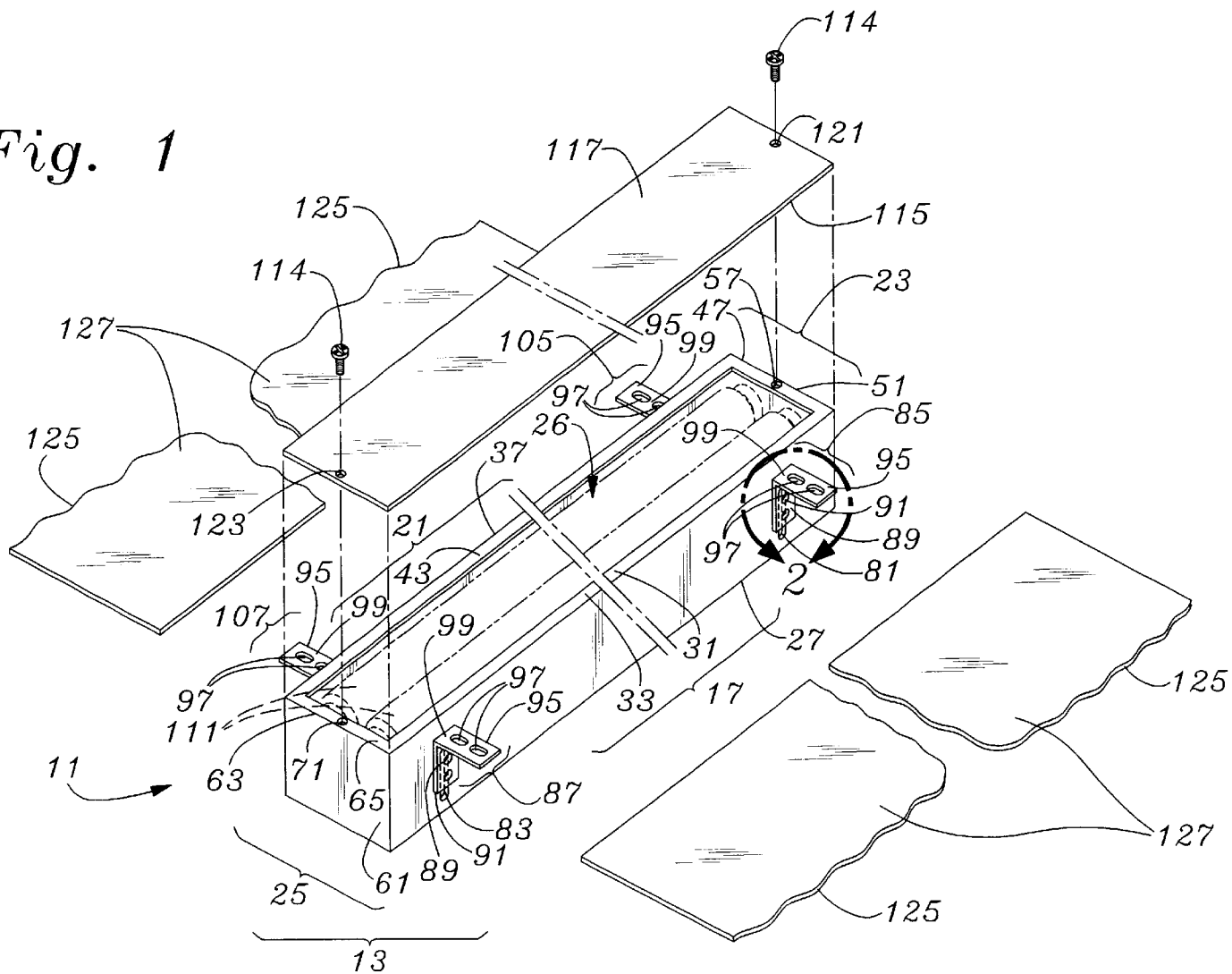
FIG. 1 is a lower perspective view of an adjustable mount lighting fixture including a housing supporting a pair of fluorescent light tubes (illustrated in phantom) and having an adjustable bracket system secured thereto with bolts and nuts through slots in the body of the housing, a face plate and screws for securing the face plate to the housing, both illustrated as exploded away from the housing, and the face plate, housing, and fluorescent light tubes shown with broken line to be any length and shown adjacent sections of mirror or wall which may also be of any length, and shown adjacent sections of mirror.

The description and operation of the invention will be best initiated with reference to FIG. 1 and which illustrates a perspective view of the adjustable mount lighting fixture 11 of the present invention and illustrates a housing 13 of a rectangular shape and having a rear enclosure 15 (shown with an under arrow), a first side 17, a second side 21 (shown with a hooked arrow) oppositely disposed from first side 17, both first and second sides 17 and 21 generally perpendicular to and contiguous with rear enclosure 15. Housing 13 further has a first end 23, and a second end 25 oppositely disposed from first end 23, first and second ends 23 and 25 generally perpendicular to and contiguous with first and second sides 17 and 21 and rear enclosure 15 and forming a partially enclosed rectangle with a front opening 26. The body members above may be formed from sheet metal by folding, welding, and the like.

First side 17 of housing 13 has a first planar portion 27 extending from rear enclosure 15 to a first edge 31 of housing 13, and a second planar portion 33 extending from first edge 31 of housing 13 in a direction perpendicular to first planar portion 27 and generally toward second side 21 and terminating adjacent front opening 26.

Similarly, second side 21 of housing 13 has a first planar portion 37 extending from rear enclosure 15 to a second edge 41 of housing 13, and a second planar portion 43 extending from second edge 41 of housing 13 in a direction perpendicular to first planar portion 37 and generally toward first side 17 and terminating adjacent front opening 26.

First end 23 of housing 13 has a first planar portion 47 (shown with a hooking lead line) extending from rear enclosure 15 to a third edge 51 of housing 13, and a second planar portion 53 extending from third edge 51 of housing 13 in a direction perpendicular to first planar portion 47 and generally toward second end 25, and having an aperture 57 therethrough. Second planar portion 53 terminates adjacent front opening 26.

Similarly, second end 25 of housing 13 has a first planar portion 61 extending from rear enclosure 15 to a fourth edge 63 of housing 13, and a second planar portion 65 extending from fourth edge 63 of housing 13 in a direction perpendicular to first planar portion 61 and generally toward first end 23, and having an aperture 71 therethrough. Second planar portion 65 terminates adjacent front opening 26.

First planar portion 27 of first side 17 has a first slot 81 therethrough situated near first end 23 of housing 13, and a second slot 83 therethrough situated near the second end 25 of housing 13. Both first and second slots 81 and 83 extend between rear enclosure 15 and front opening 26 in a direction normal to the plane containing the rear enclosure 15 and to the plane of the front opening 26. First slot 81 of first side 17 is shown adjacent a first adjustable bracket 85, and second slot 83 of first side 17 is shown adjacent a second adjustable bracket 87. First and second adjustable brackets 85 and 87 are illustrated as attached to housing 13 at slots 81 and 83 of first side 17 with bolts 89 and nuts (not yet illustrated). Slots 81 are preferably about one to two inches long and extend to about a half an inch from the front face of the fixture 11.

Each of first and second adjustable brackets 85 and 87 has a first planar portion 91 with a pair of apertures 93 therethrough, and a second planar portion 95 with a pair of elongate apertures 97 therethrough, and which together form an edge 99 therebetween first and second planar portions 91 and 95 such that first and second planar portions 91 and 95 are perpendicular to with respect to one another. Each of first planar portions 91 of adjustable brackets 85 and 87 is situated adjacent first and second slots 81 and 83, respectively, of first side 17 of housing 13 and parallel to the plane occupied by first side 17 of housing 13 with edge 99 perpendicular to and projected forward of corresponding slot 81 or 83. First planar portion 91 extends away from edge 99 toward rear enclosure 15 in a direction parallel with first side 17, and second planar portion 95 extends away from edge 99 and perpendicularly away from first side 17 of housing 13.

Similarly, the first planar portion 37 of the second side 21 has a first slot 101 (not illustrated in FIG. 1) therethrough situated near first end 23 of housing 13, and a second slot 103 (not illustrated in FIG. 1) therethrough situated near the second end 25 of housing 13. Both first and second slots 101 and 103 extend between rear enclosure 15 and front opening 26 in a direction normal to that plane containing the rear enclosure 15 and to the plane of the front opening 26. First slot 101 of second side 21 is shown adjacent a third adjustable bracket 105, and second slot 103 of second side 21 is shown adjacent a fourth adjustable bracket 107. First and second adjustable brackets 105 and 107 are illustrated as attached to housing 13 at slots 101 and 103 of second side 21 with bolts 89 and nuts (not yet illustrated).

Each of third and fourth adjustable brackets 105 and 107 has a physical configuration identical to that described for first and second adjustable brackets 85 and 87, and are situated with respect to corresponding slots 101 and 103 of the second side 21 of housing 13 exactly as adjustable brackets 85 and 87 have been described as being situated with respect to slots 81 and 83.

Bolts 89 extend through the pairs of apertures 93 of each of adjustable brackets 85, 87, 105, 107, and simultaneously gag through each of the corresponding slots 81, 83, 101 and 103, before interconnecting with their respective nuts. This configuration allows translation of the bolts 89 within the slots 81, 83, 101, and 103 and consequently for selective positioning of the adjustable brackets 85, 87, 105, 107 with respect to the housing 13 to achieve a target position of the housing 13 with respect to an anchoring structure (not yet illustrated) and thus the overall position of the adjustable mount lighting fixture 11 with respect to surrounding structures.

Illustrated in phantom in FIG. 1 is a pair of fluorescent light tubes 111 located just within the front opening 26 of the housing 13 and shown supported at their ends with supports, and shown as they would be if the adjustable mount lighting fixture 11 was fully operational. In lieu of tubes 111, a series of bulbs can be used.

Also illustrated in FIG. 1 as exploded away from the housing 13 of the adjustable mount lighting fixture 11 is a face plate 113 and screws 114 for attaching face plate 113 to housing 13 for enclosing the front opening 26 of housing 13. Face plate 113 has an interior surface 115 directed toward the housing 13, and an exterior surface 117 directed away from the housing 13. The face plate 113 may be made of acrylic in a variety of patterns and textures, or may be constructed of glass or other similar medium through which light may be at least partially transmitted. The face plate 113 has a first aperture 121 and a second aperture 123 through which screws 114 may be inserted and subsequently threaded into apertures 57 and 71, respectively, of the second planar portions 53 and 65 of each of first and second ends 23 and 25 of the housing 13 for securing the face plate 113 to the housing 13.

Finally, FIG. 1 illustrates sections of a mirror or wall 125 on either side of the adjustable mount lighting fixture 11 having an exterior surface 127 that faces in the same direction as the exterior surface 117 of the face plate 113. Note that the dashed lines shown as bisecting the housing 13, the pair of fluorescent light tubes 111, and the face plate 113 in FIG. 1 illustrate that the adjustable mount lighting fixture 11 may vary in height. Additionally, the mirror or wall 125 is illustrated as fragmented in order to convey that it may also be of any height.

Figure 2:
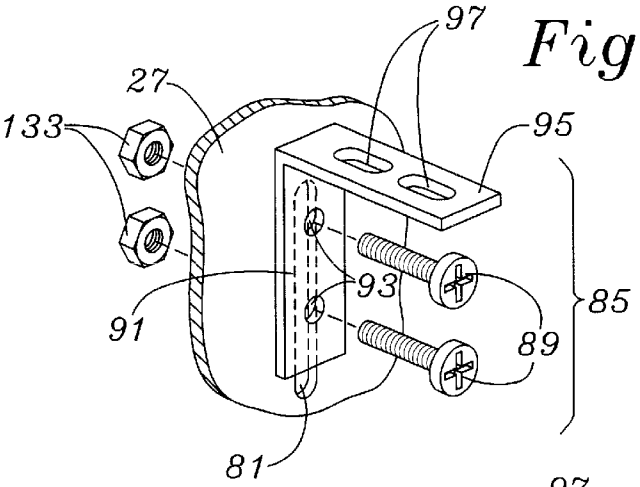
FIG. 2 is an enlarged view of a portion of the adjustable bracket system of the adjustable mount lighting fixture as in FIG. 1 which illustrates the position of the adjustable bracket with respect to the housing and slots therein, and which illustrates in greater detail the bolts extending through the apertures of the adjustable bracket and through the slots of the housing and secured by nuts illustrated in phantom.

FIG. 2 illustrates a section of the first side 17 of housing 13 of FIG. 1 as broken away and includes first slot 81 therethrough first side 17 of housing 13 and first adjustable bracket 85 adjacent and attached to housing 13 through first slot 81. FIG. 2 illustrates first and second planar portions 91 and 95 of adjustable bracket 85, both features of which, it should be noted, are common to all adjustable brackets 85, 87, 105, and 107. The overall shape of the pair of elongate apertures 97 of the second planar portion 95 of adjustable bracket 85 is also more easily realized with reference to FIG. 2. Further illustrated in FIG. 2 is a pair of bolts 89 extending through the pair of apertures 93 of the first planar portion 91 of the adjustable bracket 85, through first slot 81 of first side 17, and interconnected with a pair of nuts 133. Note that although this configuration is described with respect to a single slot 81 and corresponding adjustable bracket 85, the described configuration applies to each of the four slots 81, 83, 101, 103 and their corresponding adjustable brackets 85, 87, 105, and 107. When the nuts 133 are loosened, the bolts 89 become moveable within and translatable along slot 81, and thus the adjustable bracket 85 becomes slidable and fixable in a variety of positions along slot 81. All adjustable brackets 85, 87, 105, and 107, may be positioned so that once the housing 13 is fastened to an anchoring structure (not illustrated in FIG. 2), a flush fit or other such customized fit of the face plate 113 of the adjustable mount lighting fixture 11 with respect to the adjacent wall or mirror 125 may be achieved. The position may be further adjusted with respect to the additional dimension present by attaching the face plate 113 to the housing 13. Once the adjustable bracket 85 has been positioned as necessary to achieve the desired fit, nuts 133 may be tightened in order to fixably secure the adjustable bracket 85 to the housing 13. Another customized fit of the adjustable mount lighting fixture 11 may be achieved by positioning the adjustable brackets 85, 87, 105, and 107 so that the exterior surface 117 of the face plate 113 projects just forward of, but still parallel with, the plane of the exterior surface 127 of the adjacent mirror or wall 125 when the face plate 113 is attached to the housing 13. Likewise, the adjustable brackets 85, 87, 105, and 107 may be positioned so that the exterior surface 117 of the face plate 113 is recessed with respect to the exterior surface 127 of the adjacent mirror or wall 125. The ability to selectively locate the adjustable brackets 85, 87, 105, and 107 with respect to the housing 13 allows a user a choice of customized applications with regard to the fit of the exterior surface 117 of the face plate 113 with respect to the exterior surface 127 of the adjacent mirror or wall 125. The pair of elongate apertures 97 on the second planar portion 95 of each of adjustable brackets 85, 87, 105, and 107 also allow for lateral adjustment of the housing 13 prior to fastening the housing 13 to an anchoring structure.

Figure 3:
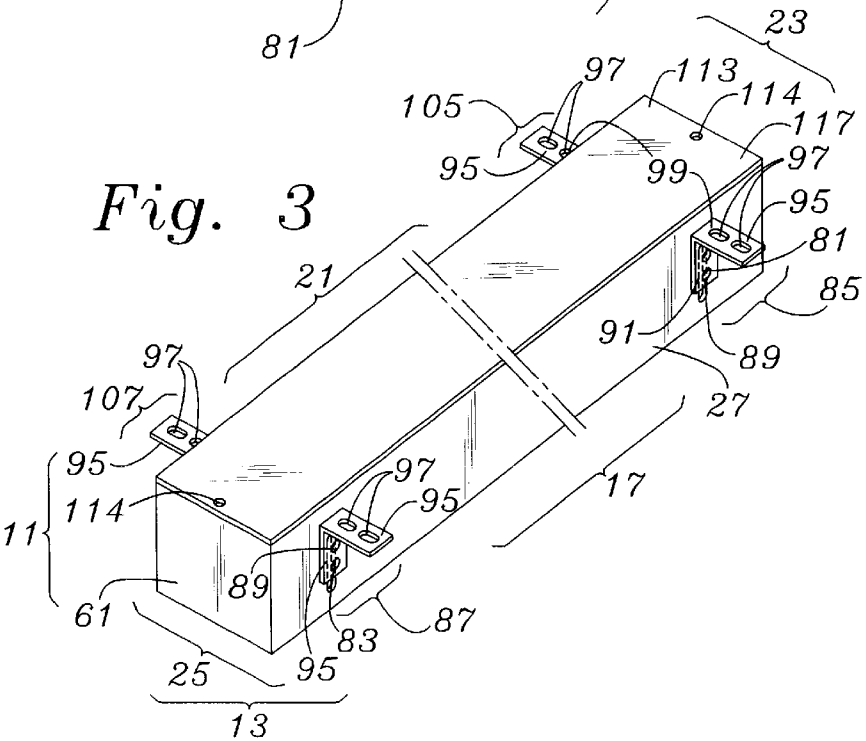
FIG. 3 is a view as in FIG. 1 of the adjustable mount lighting fixture which illustrates the housing with adjustable brackets and face plate attached thereto.

FIG. 3 is a view of the adjustable mount lighting fixture 11 as in FIG. 1 with the face plate 113 attached to housing 13 with screws 114 and with exterior surface 117 of the face plate 113 exposed. Also illustrated in FIG. 3 are the two adjustable brackets 85 and 87 adjacent first side 17 of housing 13, and the two adjustable brackets 105 and 107 adjacent second side 21 of housing 13. The pairs of elongate apertures 97, second planar portions 95, and edges 99 of all adjustable brackets 85, 87, 105, and 107, can be seen in FIG. 3. Furthermore, the first planar portions 91 of adjustable brackets 85 and 87 are also visible. First and second ends 23 and 25 of the housing 13 are also included in FIG. 3. As in FIG. 1, the dashed lines of FIG. 3 indicate that the adjustable mount lighting fixture 11 may be of any height.

Figure 4:
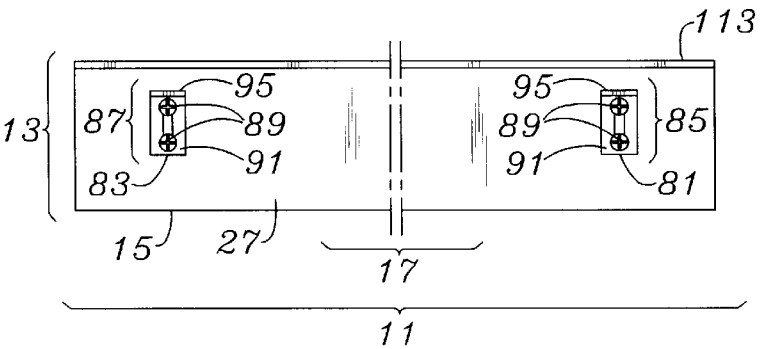
FIG. 4 is a side view of the adjustable mount lighting fixture which illustrates the housing with adjustable brackets and face plate attached thereto, the opposite side view of the adjustable mount lighting fixture being identical.

FIG. 4 is a side view of the adjustable mount lighting fixture 11, the view of the opposite side of the adjustable mount lighting fixture 11 being identical. FIG. 4 illustrates the first side 17 of housing 13 with face plate 113 attached to housing 13 and adjustable brackets 85 and 87 attached to first planar portion 27 of first side 17 of the housing 13 with bolts 89. First and second planar portions 91 and 95 of each of adjustable brackets 85 and 87 may also be seen in FIG. 4.

Figure 5:
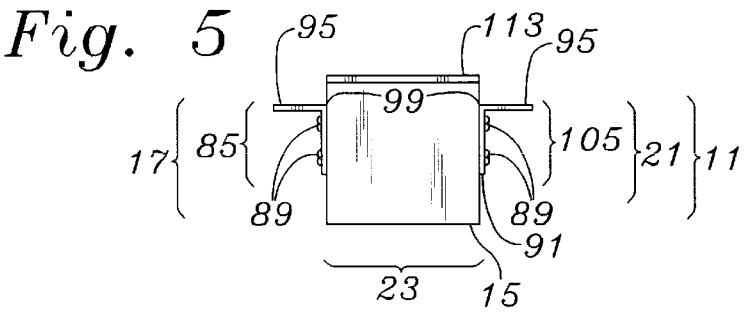
FIG. 5 is an end view of what could be either end of the adjustable mount lighting fixture which illustrates the housing with adjustable brackets and face plate attached thereto.

FIG. 5 is an end view of the adjustable mount lighting fixture 11, the view of opposite end of the adjustable mount lighting fixture 11 being identical. FIG. 5 illustrates first end 23 of housing 13, and illustrates adjustable bracket 85 attached to first side 17 of housing 13, and adjustable bracket 105 attached to second side 21 of housing 13 with bolts 89. Face 37 plate 113 is illustrated as attached to housing 13.

Figure 6:
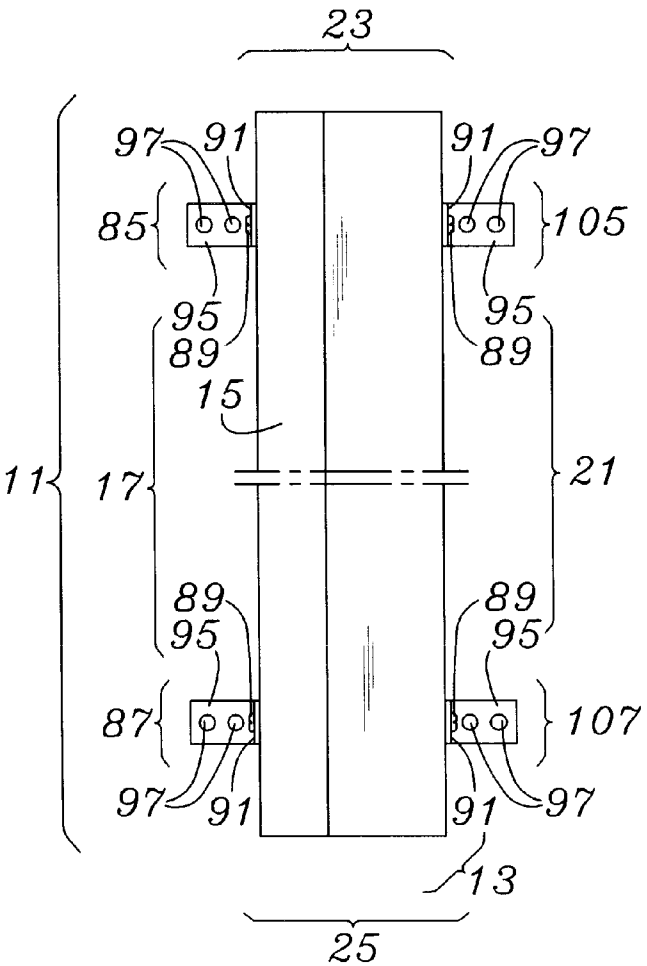
FIG. 6 is a rear view of the adjustable mount lighting fixture which illustrates the housing and adjustable brackets attached.

FIG. 6 is a rear view of the adjustable mount lighting fixture 11 which illustrates the rear enclosure 15, two adjustable brackets 85 and 87 attached to first side 17 of housing 13, and two adjustable brackets 105 and 107 attached to second side 21 of housing 13 with bolts 89. First planar portions 91 of all adjustable brackets 85, 87, 105, and 107 are visible with pairs of elongate apertures 97, and a partial view of the second planar portions 95 are also visible in this FIGURE.

Figure 7:
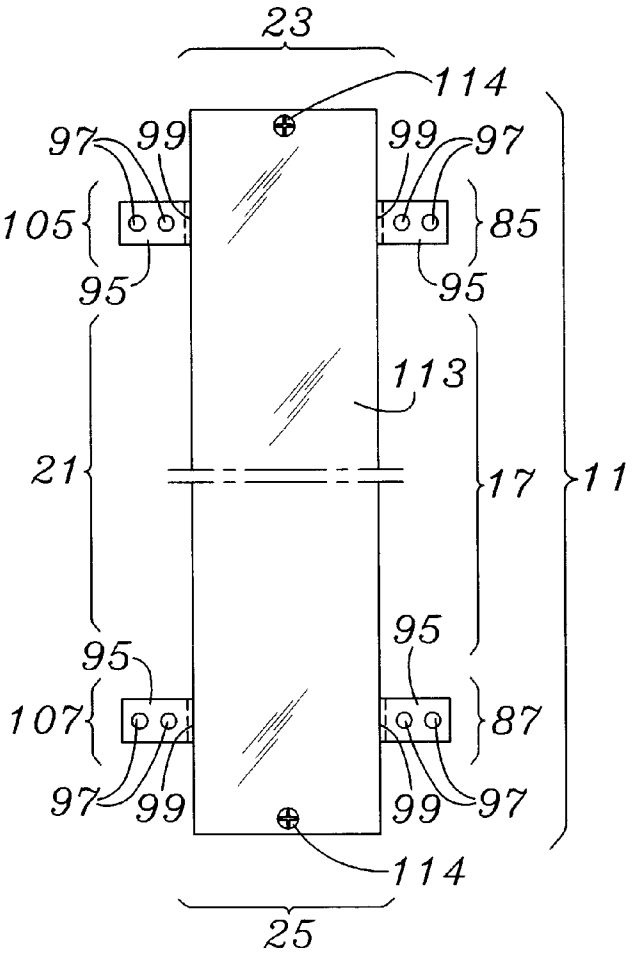
FIG. 7 is a plan frontal view of the adjustable mount lighting fixture which illustrates the face plate and adjustable brackets as attached to the housing.

FIG. 7 is a plan frontal view of the adjustable mount lighting fixture 11 which illustrates two adjustable brackets 85 and 87 adjacent first side 17 of housing 13, and two adjustable brackets 105 and 107 adjacent second side 21 of housing 13. The second planar portions 95 of each of the adjustable brackets 85, 87, 105, and 107 with pairs of elongate apertures 97 may be seen in this FIGURE.

Figure 8:
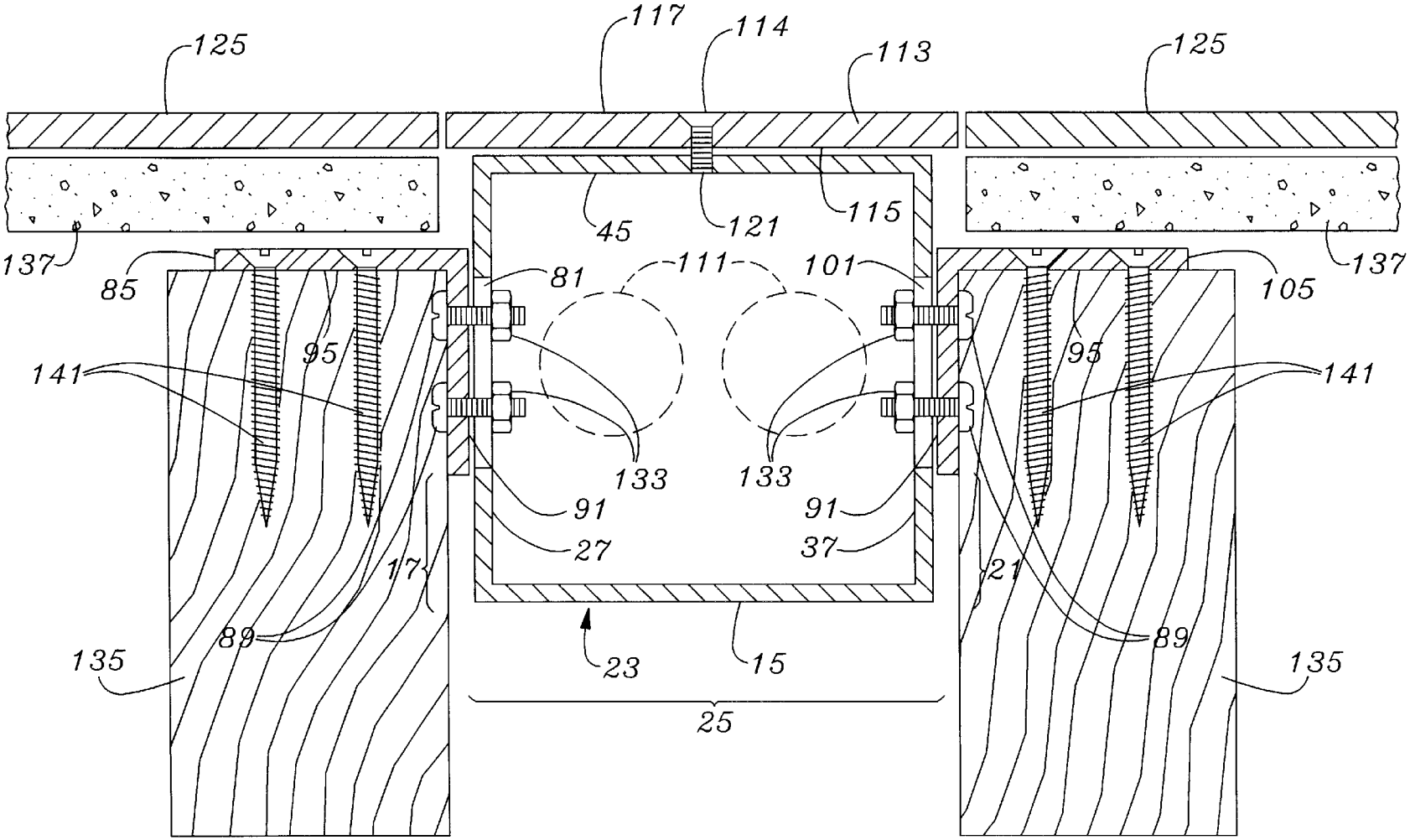
FIG. 8 is a cross-sectional end perspective of the housing of the adjustable mount lighting fixture as attached to the adjustable brackets with pairs of nuts and bolts, the adjustable brackets fastened to an anchoring structure within a wall with pairs of screws, the fluorescent light tubes (illustrated in phantom) within the housing, and the face plate attached to the housing with screws, all elements of the adjustable mount lighting fixture illustrated as having been positioned so that the exterior surface of the face plate is coplanar with the exterior surface of the surrounding mirror or wall in a flush configuration.

FIG. 8 is a cross-sectional end perspective of the first end 23 of the housing 13 of the adjustable mount lighting fixture 11 as fastened to an anchoring structure 135 within a wall 137 and illustrates two of the adjustable brackets 85 and 105. FIG. 8 illustrates the pair of fluorescent light tubes 111 (in phantom) within the front opening 26 of housing 13 as they would be positioned if the adjustable mount lighting fixture 11 were fully operational. Both first and second planar portions 91 and 95 of the two adjustable brackets 85 and 105 may be seen in FIG. 8. The two adjustable brackets 85 and 105 are shown as secured to the housing 13 along through the two of the slots 81 and 101 (not illustrated in this FIGURE), respectively with bolts 89 and nuts 133. The adjustable mount lighting fixture 11 of FIG. 8 is illustrated with face plate 113 attached with screws 114, the exterior surface 117 of which is situated flush relative to the adjacent mirror or wall 125. Note that although structure 137 has been defined as a wall in this illustration, structure 125 continues to be defined as either a mirror or a wall, and if a wall would simply be an extension of wall 137 in the form or sheetrock or some other similar finishing material, for example. The housing 13 of the adjustable mount lighting fixture 11 is attached to anchoring structure 135 by wood screws 141. Each pair of wood screws 141 is shown extending through a corresponding pair of elongate apertures 97 in the second planar portion 95 of each of the two adjustable brackets 85 and 105, or 87 and 107. In this illustration, the housing 13 of the adjustable mount lighting fixture 11 is mounted so that the exterior surface 117 of the face plate 113 is coplanar with the exterior surface 127 of the adjacent mirror or wall 125.

While the present invention has been described in terms of an adjustable mount lighting fixture, the principles contained herein are applicable to other types of custom lighting systems.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. An adjustable mount lighting fixture for a lighting system comprising:

a housing having a rear member, and continuous with and perpendicular to a first side member, second side member, third side member, and fourth side member to form a rectangular enclosure, housing having at least four slot openings for facilitating adjustable attachment of said housing to an anchoring structure located with respect to a wall having at least one exterior surface and containing a support for at least one of a light bulb or light tube;

four attachment members, one attachment member for each of said four openings, said attachment member having at least a first aperture therethrough for facilitating adjustable attachment of said opening of said housing to said attachment member, and at least a second aperture therethrough for facilitating fastening of said attachment member to said anchoring structure;

at least one bolt and one nut for each of said four slot openings, said bolt extending through said at least one aperture of said attachment member and through said opening of said housing and interconnected with said nut for adjustably securing said housing to said attachment member, and wherein each said bolt and each of said four attachment members is translatable along said slot to facilitate positioning of said attachment member along said slot through a variety of selectable positions;

a light transmissible face plate having an exterior surface directed generally away from said housing, said face plate fitable and fixably securable to said housing; and wherein at least two of said first side member, second side member, third side member, and fourth side member has a first planar portion contiguous with and extending from said rear member to an edge, and a second planar portion contiguous with said edge and extending away from said edge and in a direction perpendicular to said first planar portion, and wherein each of said second planar portions has an aperture therethrough for securing said face plate to said housing, a position of said exterior surface of said face plate being adjustable with respect to said exterior surface of said wall structure by adjustment of position of said attachment members.

2. The adjustable mount lighting fixture as recited in claim 1 and wherein said variety of selectable positions of s id attachment member with respect to said housing along said slot includes a position wherein said exterior surface of said ace plate is coplanar with said exterior surface of said all structure adjacent said face plate.

3. The adjustable mount lighting fixture as recited in claim 1 and wherein said variety of selectable positions of said attachment member with respect to said housing along said lot includes a position wherein said exterior surface of said face plate projects forward of said exterior surface of said wall structure adjacent said face plate.

4. The adjustable mount lighting fixture as recited in claim 1 and wherein said variety of selectable positions of said attachment member with respect to said housing along said slot includes a position wherein said exterior surface of said face plate is recessed with respect to said exterior surface of said wall structure adjacent said face plate.

5. The adjustable mount lighting fixture as recited in claim 1 and further comprising at least one screw for fixing said attachment member to said support structure, said screw extending through said at least second aperture of said attachment member and into said support structure.

6. The adjustable mount lighting fixture as recited in claim 1 and wherein said at least second aperture of said attachment member is a slot, and wherein said screw is extendable through said slot at a variety of positions for facilitating lateral adjustment of said housing and said attachment member prior.

7. The adjustable mount lighting fixture as recited in claim 1 and wherein each of said four attachment members further comprise a first planar portion through which said at least first aperture extends, and a second planar portion through which said at least second aperture extends, aid second planar portion contiguous with and extending generally perpendicularly away from said first planar portion.

8. The adjustable mount lighting fixture as recited in claim 1 and further comprising a screw, extendable through said face plate and simultaneously though said aperture of said at least one of second planar portions of said sides of said housing for securing said face plate to said housing.

* * * * *